US006115884A

United States Patent [19]

DeJong et al.

[11] Patent Number: 6,115,884

[45] Date of Patent: Sep. 12, 2000

[54] WINDOW BALANCE

[75] Inventors: Paul S. DeJong, Ames, Iowa; Jeffrey Huston, deceased, late of West Des Moines, Iowa, by Patricia Huston, executor

[73] Assignee: Iowa State University Research Foundation Inc., Ames, Iowa

[21] Appl. No.: 09/107,689

[22] Filed: Jun. 30, 1998

Related U.S. Application Data

[60] Provisional application No. 60/052,280, Jul. 11, 1997.

[51] Int. Cl.[7] ..... E05F 3/00

[52] U.S. Cl. ..... 16/197; 49/445

[58] Field of Search ..... 16/197, 193, DIG. 16, 16/DIG. 1; 49/445, 446, 447

[56] References Cited

U.S. PATENT DOCUMENTS

| | | | |
|---|---|---|---|
| 1,864,745 | 6/1932 | Larson . | |
| 2,041,646 | 5/1936 | Larson | 16/197 |
| 2,415,614 | 2/1947 | Tappan | 16/197 |
| 2,477,069 | 7/1949 | Larson | 16/197 |
| 2,565,804 | 8/1951 | DeVires et al. | 16/197 |
| 2,580,705 | 1/1952 | Tappan | 16/197 |
| 2,604,655 | 7/1952 | Peremi | 16/197 |
| 2,622,267 | 12/1952 | Peremi | 16/197 |
| 2,637,875 | 5/1953 | Hess | 16/197 |
| 2,659,929 | 11/1953 | Hess | 16/197 |
| 2,702,920 | 3/1955 | DeVries et al. | 16/197 |
| 2,774,100 | 12/1956 | Larson et al. | 16/197 |
| 2,776,447 | 1/1957 | Addicks | 16/197 |
| 2,780,457 | 2/1957 | Larson | 267/1 |
| 2,792,588 | 5/1957 | Gency | 16/197 |
| 2,792,589 | 5/1957 | Young | 16/201 |
| 2,793,389 | 5/1957 | Larson | 16/197 |
| 2,817,872 | 12/1957 | Foster | 16/197 |
| 2,825,088 | 3/1958 | Decker et al. | 16/197 |
| 2,825,089 | 3/1958 | Larson et al. | 16/197 |
| 2,851,721 | 9/1958 | Decker et al. | 16/197 |
| 2,943,345 | 7/1960 | Ammerman | 16/197 |
| 3,195,193 | 7/1965 | Foster | 20/52 |
| 3,271,812 | 9/1966 | Skolnik | 16/197 |
| 3,286,301 | 11/1966 | Skolnik | 16/197 |
| 3,844,066 | 10/1974 | Nobes | 49/182 |
| 4,423,536 | 1/1984 | Cross | 16/197 |
| 4,452,012 | 6/1984 | Deal | 49/181 |
| 4,517,766 | 5/1985 | Haltuf | 49/417 |
| 4,953,256 | 9/1990 | Salmela et al. | 16/1 C |
| 5,152,032 | 10/1992 | Davis et al. | 16/197 |
| 5,267,416 | 12/1993 | Davis | 49/447 |

FOREIGN PATENT DOCUMENTS

| | | |
|---|---|---|
| 465925 | 6/1937 | United Kingdom . |
| 819094 | 8/1959 | United Kingdom . |

*Primary Examiner*—Chuck Y. Mah
*Attorney, Agent, or Firm*—Robert A. Seemann

[57] ABSTRACT

In a counterbalance having a torsion spring which is torqued by a thread follower rotated by axially reciprocal movement of a spiral rod through the follower and into the torsion spring, the pitch of the spiral thread changes continuously, smoothly and consistently at a nonlinear rate according to an equation.

6 Claims, 5 Drawing Sheets

WINDOW BALANCE

This application claims the benefit of U.S. Provisional Application No. 60/052,280 filed Jul. 11, 1997.

BACKGROUND OF THE INVENTION

1. Field of the Invention

The invention pertains to counterbalance mechanisms, more specifically to a window sash counterbalance having a torsional spring that is torqued by a stiff spiral rod that drives a follower attached to one end of the spring as the spiral rod is drawn through the follower by movement of the window sash.

2. Description of the Prior Art

Counterbalancing mechanisms provide the user with easy and safe product operation by compensating for a product's weight when the item must be moved vertically.

Counterweight has been used comprising a lead weight suspended from a rope which passes over a pulley at the top of the window frame and is attached to the edge of the window sash whereat an upward pull is made upon the sash.

Overhead garage doors are often counterbalanced by an extension spring which runs horizontally along the rails of the garage door or a torsional spring mounted above the door.

A counterbalance mechanism, described in U.S. Pat. No. 2,817,872, patented Dec. 31, 1957 by E. E. Foster, has a self-coiling coil ribbon spring under constant tension attached to the window frame or head jamb and the window sash, which is wound and unwound by vertical movement of the sash.

U.S. Pat. No. 1,864,745 patented Jun. 28, 1932 by A. Larson describes a window sash balance in which a tubular coil spring is attached by one end of the spring to the upper end of the window frame and is fixed against rotation at the attachment.

A cap having a cylindrical opening with an internal constriction is fixedly mounted to the spring on the other end of the spring which is not attached to the window frame or the window sash.

An elongated spiral rod has a convoluted longitudinal groove that provides a pair of longitudinal ridges that define the pitch of the spiral. One end of the rod is attached to the sash, fixed against rotation at the attachment. The other end of the rod extends through the constriction in the cap and axially into the spring.

The balance is installed on the lower sash and frame with the spiral portion of the rod disposed inwardly of the coil and with the lower sash raised. When the sash is lowered to the closed position, the coil spring is twisted or torqued by the cap which is forced by the spiral to rotate as the spiral moves in extension from the spring through the internal constriction. When the lower sash is raised, the coil spring is revolved around the spiral by the cap in the opposite direction thus releasing the torsion acquired when the sash was lowered.

The spring may be pretorqued by detaching and twisting it at the end attached to the frame.

The pitch of the convoluted groove increases gradually from one end of the rod to the other end of the rod, the pitch being less at the end attached to the sash. When the sash is in the closed position the spiral is retracted out of the coil and the coil is wound to maximum tension. The coil revolves relatively slowly at the higher pitch end of the rod. The increased pitch prevents the highly torqued spring from drawing the window open by drawing the rod into the spring.

The gradually decreasing pitch provided in the spiral toward the end attached to the sash facilitates rotary movement of the coil as the sash is moved into the open position and torque in the coil is consequently decreased. The rotary movement of the coil about the spiral is relatively fast at first as the sash is moved into the closed position from the extended position and the movement of the coil is relatively slow as the spiral reaches the extended position.

U.S. Pat. No. 5,267,416 patented Dec. 7, 1993 by D. Davis describes a torsion spring window balance having a torsion spring in a rigid tube. The first end of the spring is fixedly attached to the first end of the tube. A nut is journalled within the second end of the tube and is connected to the second end of the torsion spring for rotating the second end of the spring. A spiral rod threadably engages the nut and extends into the spring.

The first end of the tube is attached to the window frame. The end of the rod that is outside the spring is attached to the sash shoe to communicate in the form of lifting force on the sash, the tensive force between the spiral rod and the tube transformed by the nut from the torque produced between the ends of the torsion spring.

The pitch of the spiral rod is varied according to an algebraic quadratic relationship. It provides a lifting force along about the lower 80% of sash vertical travel and about a 5% higher lifting force for the remaining upper travel or raised positioning of the sash.

SUMMARY OF THE INVENTION

It is one object of the invention to provide a counterbalance mechanism that has a tubular torsion spring which is torqued by a follower which is rotated by reciprocal axial movement of a spiral rod disposed through the follower and into the spring.

It is another object that the spiral rod is disposed generally axially within the follower and spring.

It is another object of the invention to provide constant lift by the counterbalance over the range of counterbalanced travel of an item counterbalanced by the counterbalance.

It is another object of the invention that the pitch of the spiral of the rod changes continuously along the rod at a nonlinear rate so that the lifting force of the balance provided by the combined spiral and spring is constant over the range of counterbalance of the item.

It is another object of the invention that the pitch of the spiral of the rod changes continuously along the rod at a consistent nonlinear rate over the length of rod which passes through the follower related to the range of counterbalanced travel of an item counterbalanced by the counter balance mechanism.

It is another object of the invention that the pitch of the spiral of the rod changes continuously along the rod according to a consistent nonlinear rate at which the lifting force of the balance provided by the combined spiral and spring is constant over the range of counterbalanced travel of the counterbalanced item.

It is another object of the invention that the pitch of the spiral of the rod changes continuously along the rod at a consistent nonlinear rate so that the lifting force of the balance provided by the combined spiral and spring changes over the range of counterbalanced travel of the counterbalanced item.

Other objects and advantages will become apparent to a reader from the ensuing description of the invention.

In a counterbalance apparatus that includes a torsion spring having a first end and a second end, means for holding the first end of the torsion spring against rotation connected to the first end of the torsion spring, means for following connected to the second end of the spring, a spiral rod having a first end and a second end, the first end of the spiral rod extending through the means for following and into the torsion spring, the second end of the spiral rod comprising means for attaching an item to be counterbalanced by the counterbalance apparatus, the spiral rod having threads the pitch of which varies along a portion of the rod which extends through the means for following and into the torsion spring, the means for following being configured to be rotated by the threads of the spiral rod as the spiral rod is reciprocated through the means for following and by the rotation to rotate the second end of the torsion spring, the improvement comprises the pitch of the threads of the spiral rod changing continuously along the rod at a nonlinear rate over the length of the rod that passes through the means for following for balancing an item.

The above counterbalance apparatus may be constructed so that the pitch of the threads of the spiral rod changes continuously along the rod at a consistent nonlinear rate over the length of the rod that passes through the means for following for balancing an item.

The above counterbalance apparatus may be constructed so that the pitch of the threads of the spiral rod changes continuously over the length of the rod that passes through the means for following for balancing an item, according to a trigonometric equation which describes the magnitude of the helix angle of the device wherein successive derivatives of the equation which describe the rate of change of the helix angle and the change of the rate of change of the helix angle are continuous and non-linear.

BRIEF DESCRIPTION OF THE DRAWINGS

In order that the invention be more fully comprehended, it will now be described, by way of example, with reference to the accompanying drawings, in which.

DESCRIPTION OF THE PREFERRED EMBODIMENTS

Figure 1:
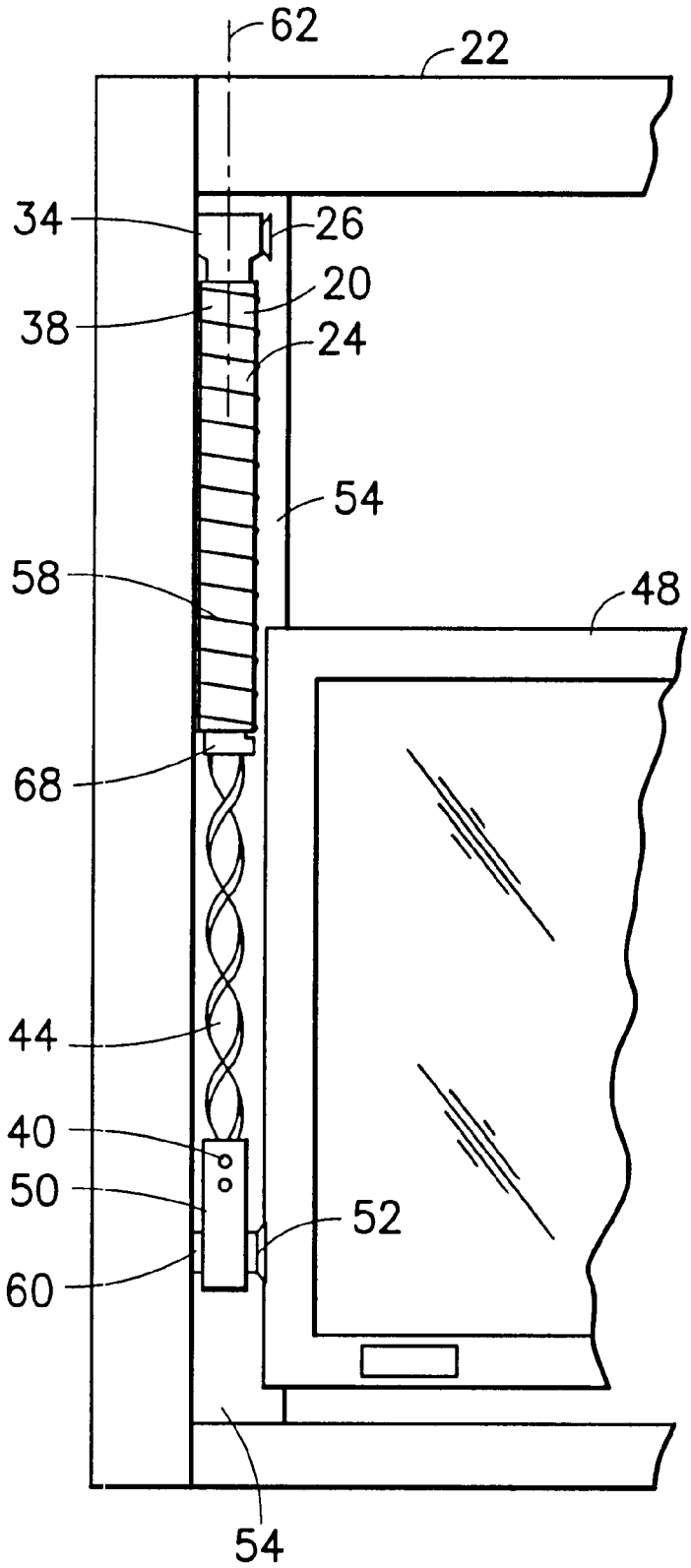
FIG. 1 a schematic view of a counterbalance of the invention attached to a window frame and sash.

Before explaining the invention in detail, it is to be understood that the invention is not limited in its application to the detail of construction and arrangement of parts illustrated in the drawings since the invention is capable of other embodiments and of being practiced or carried out in various ways. It is also to be understood that the phraseology or terminology employed is for the purpose of description only and not of limitation.

Figure 2:
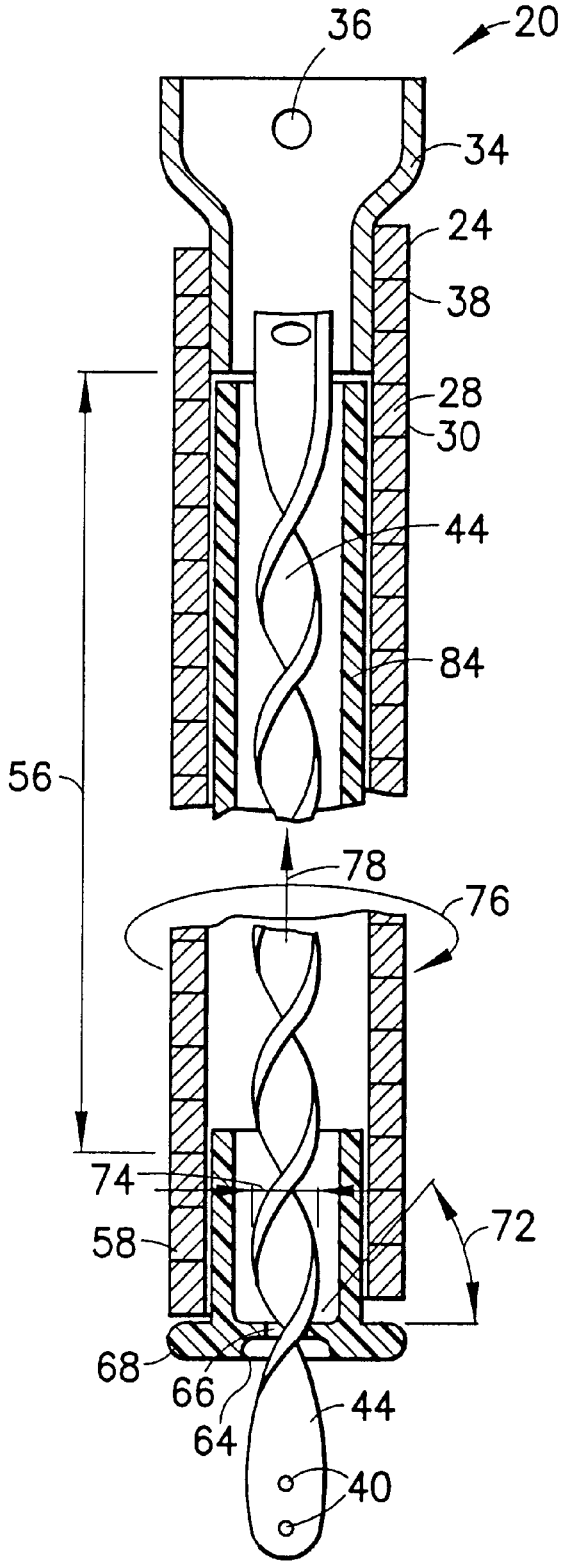
FIG. 2 a cross section schematic view of the counterbalance of FIG. 1.

Referring to FIGS. 1 and 2, torsion spring counterbalance 20 is attached to window frame 22 by wood screw 26 through hole 36 in mounting collar 34 so that end 38 of tubular torsion spring 24 cannot rotate with respect to the window frame.

A torsion spring counterbalance is defined herein as a spring counterbalance that uses only a torsion-type spring. This is different from a spring counterbalance that combines a torsion spring and a tension spring to balance the load.

The object which is to be counterbalanced, such as sash 48 is supported by locking balance shoe 50 which rides in vertical window track 54 with one side of the sash. The sash can turn inward on pivot 52 of the shoe which presses brake 60 against the window frame when the sash is turned in. The locking balance shoe is attached to pins 40 of spiral rod 44 so that spiral rod 44 cannot turn with respect to shoe 50 or sash 48.

End 58 of spring 24 is free to rotate about axis 62.

Tubular torsion spring 24 is wound in circular coils 28, although the coils may be wound in square or other configurations. Wire 30 which forms the coils is preferably rectangular or square in cross section to stabilize the circumferential wall of the spring so that it is a self supporting tube and no outer rigid support wall is added to support the spring.

Wire 30 is strong and stiff enough so that spring 24 does not stretch along length 56 when the counterbalance is at its maximum rated balance load and the lower end of the spring is free or not externally supported.

Spiral rod 44 may be made by twisting flat ribbon metal, machined from solid stock to form a cylindrical core with threads, or other manufacturing practice for making a spiral or threaded elongated member. Spiral rod 44 passes through constriction 64 in opening 66 of follower 68 and axially into spring 24. Follower 68 is mounted on end 58 of the spring so that the spring is twisted by the follower when the follower is rotated. The follower is rotated on axis 62 by the spiral as the spiral moves through constriction 64 when spiral rod 44 is extended from within the spring by lowering of the sash, and retracted into the spiral by raising of the sash.

Although the spiral rod moves axially within the spring, it can lean radially toward the spring. Free floating plastic tube 84 reduces friction between spiral rod 44 and spring 24 which can occur when the spiral rod leans in a radial direction toward the spring.

The spiral is pitched so that torque is added to the spring by the follower when the sash is lowered. The torque added to the spring biases the follower toward drawing the sash upward by the spiral.

The spring may be pretorqued so that the counterbalance provides a supplemental minimum lift to the sash or other counterbalanced item.

The twist of the spiral in the present invention matches the mechanical characteristics of any spring used, to produce any desired lift force as a function of vertical displacement of the helical rod, throughout the entire operational range of the counterbalance mechanism.

The helix is made according to equation (1);

$$\text{lambda}(z)=\arctan(k(z)*\text{phi}(z)/(L(z)*r(z))) \quad (1)$$

where;

*=multiplier symbol;

z=distance along the longitudinal axis of the helix;

lambda=helix angle as a function of vertical displacement z, defined as the angle between the helical surface of a thread and a plane perpendicular to the helical rod's longitudinal axis;

k=torsional spring stiffness as a function of vertical displacement z;

phi=rotation of the torsional spring as a function of vertical displacement z;

L=desired lift as a function of vertical displacement z;

r=radius of the spiral rod as a function of vertical displacement z.

In FIG. 2, the respective numerical designator;

for lambda=72, for 2 r=74, for rotation angle phi=76, for lift=78.

Equation (1) provides a pitch change which is continuous along the rod at a consistent non-linear rate over the length of the rod, a smoothness of spiral transition. It provides an accurate description of the spiral profile for any type of desired lifting force, constant, linearly or non-linearly increasing or decreasing, without resorting to approximations for discrete distances along the spiral rod between the operating ends of the spiral.

When equation is applied consistently, it is applied as a unitary, constant, complete instruction for making the pitch change along the complete length of the rod that moves through the follower over the counterbalanced range of travel of the item being counterbalanced.

The equation describes a rod and spring combination which precisely balances an item's weight throughout the range of counterbalanced travel of the rod. The equation can be augmented to adjust for change in weight experienced at the lifting attachment of particular items such as the handle of an overhead garage door.

The equation provides for variation in spring geometry, spring material, and for mathematically definable load characteristics.

To use the equation, the torsion spring is first designed to support the load without stretching (opening) using well-known spring design technology. For any given physical situation, there are a variety of configurations that can accomplish this, depending on the material requirements, space limitations, and range of operation.

The second step is to use the spring characteristics and a selected initial helix angle of the spiral rod in the equation to determine both the required pretorque and all successive helix angles of the rod in small increments of spring rotation producing relative motion between the rod and the follower 68, which relative motion defines the range of motion.

A. If the load to be counterbalanced is constant, the L(z) term in the equation is constant.

$$L(z)=W$$

B. In order to apply this same fundamental equation to counterbalance an overhead segmented garage door, the lift required to counterbalance the door decreases almost linearly during upward travel as successive segments of the door are rotated onto and carried by the horizontal portions of the overhead rails. This means that the load increases during downward travel as the spiral rod is withdrawn from the spring, and the load can be expressed as $$L(z)=W_o-S*(H-z)$$

where;

*=multiplier symbol;

L(z)=the lifting force necessary as a function of door position;

$W_o$=the full weight of the door;

H=the distance between the garage floor and the door bottom piece in the raised position;

z=the amount of travel experienced by the spiral rod; that is, the distance the rod is withdrawn from the spring;

(H−z)=the instantaneous distance between the door sill piece and the garage floor;

S=the rate of weight of loss of the door as it rotates to the horizontal rails, a nearly constant value, specific to the door design.

If the weight loss is nonlinear for a particular design, then the load term would take the form.

$$L(z)=W_o-S*(H-Z)-T(H-Z)^2-U(H-z)^3 \ldots$$

where the constants, S, T, U . . . are determined empirically to describe the nonlinearity.

C. If the load increases with upward travel (decreases with downward travel), as would be experienced when parts are lowered into a liquid which buoys them up, for example, the rate of weight gain is dependent upon part geometry and density of both liquid and the dipped part. As shown for example in a dipping process in FIG. 6, the lifting force changes linearly to counterbalance the load. In general, the load expression required in the equation would be of the form $$L(z)-W_o-A*z-B*z^2-C*z^3 \ldots$$

where;

A, B, C . . . are determined empirically to describe the actual situation;

z=the distance the rod is withdrawn from the spring.

Some prior art counterbalance helixes are formed according to second-order power equations which do not exhibit continuity and nonlinearity of higher derivatives.

The spiral rod helix of the invention is made according to a trigonometric equation which describes the magnitude of the helix angle of the device wherein successive derivatives of the equation which describe the rate of change of the helix angle and the change of the rate of change of the helix angle are continuous and non-linear.

Equation 1 is a preferred equation of this type.

The concept in the equation dramatically extends the state of the art in that the curve produced by this relationship is both trigonometrically nonlinear and continuous and also continuous and nonlinear in its higher-order derivatives describing velocity, acceleration, etc. These qualities are responsible for smoother operation of the counter balance over its entire range of motion. The equation allows the manufacturer to adjust the relationship between the initial pretorque applied to the counterbalance spring and the initial spiral angle of the counterbalance spiral in order to optimize product performance. All of these qualities dramatically alter and improve what is commonly practiced in manufacturing counterbalances today.

Figure 3:
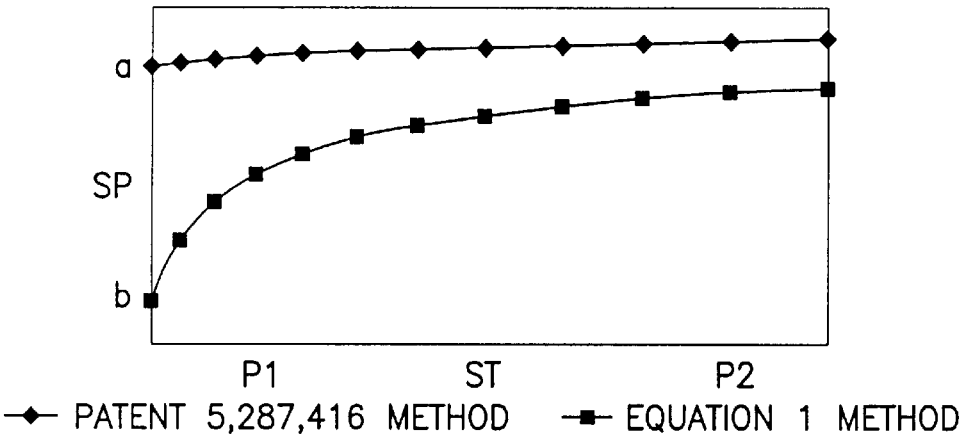
FIG. 3 is a graph comparing a prior art pitch change with a pitch change of the invention.

FIG. 3 compares the pitch change curve calculated for a torsion-spring counterbalance, that is for a balance in which the spring is only a torsion type spring, for an 11.4 pound load and 24 inch travel using the prior art equation for a torsion spring balance disclosed in U.S. Pat. No. 5,267,416 at curve (a), and using equation 1 of the invention at curve b.

The characteristics of equations for the spiral which may be used according to the present invention include:

1. A curve that is concave.
2. A curve that exhibits a pronounced upward bulge when increasing values of helix angle are plotted as a function of increasing position along the spiral rod.
3. In addition to the preferred equation, equations that allow a large range of starting angles for the helix down to below 55 degrees.
4. A curve made by a cubic equation or higher degree.
5. An equation whose generated shape comprises a continuously changing shape to the curve which is steep at the lower end and relatively flat at the higher end (see FIG. 5).
6. A curve whose helix angles are smaller and rapidly changing at the lower end of the rod and larger but slowly changing at the upper end of the rod.

In FIGS. 3–9, the vertical coordinate LF is lifting force, the vertical coordinate SP is spiral pitch, horizontal coordinate ST is sash travel horizontal coordinate IT is item travel, horizontal coordinate DT is door travel, P1 is the upper end of travel of the sash or item or door, and where the spiral rod is retracted into the spring, and P2 is the lower end of travel of the sash or item or door and where the spiral rod is extended out of the spring.

In FIGS. 6–9, the vertical coordinate LF is lifting force, the vertical coordinate SP is spiral pitch, horizontal coordinate ST is travel of the counterbalanced item, P1 is the upper end of travel of the sash (garage door in FIGS. 8 and 9), that is where the sash or door is up and the spiral rod is retracted into the spring, and P2 is the lower end of travel of the counterbalanced item where the sash is down and the spiral rod is extended out of the spring. The lower pitch of the spiral rod is at the end of the rod that is toward the sash. The lower the pitch, the more helix or thread turns there will be per linear inch of rod.

Figure 4:
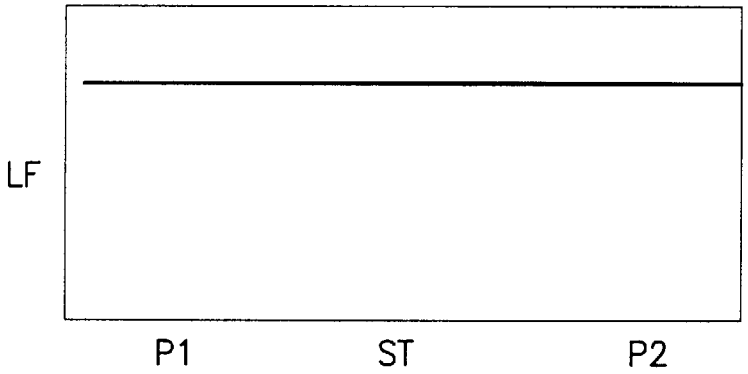
FIG. 4 is a graph of lifting force of the counterbalance of FIG. 1, as a function of sash travel distance.
Figure 5:
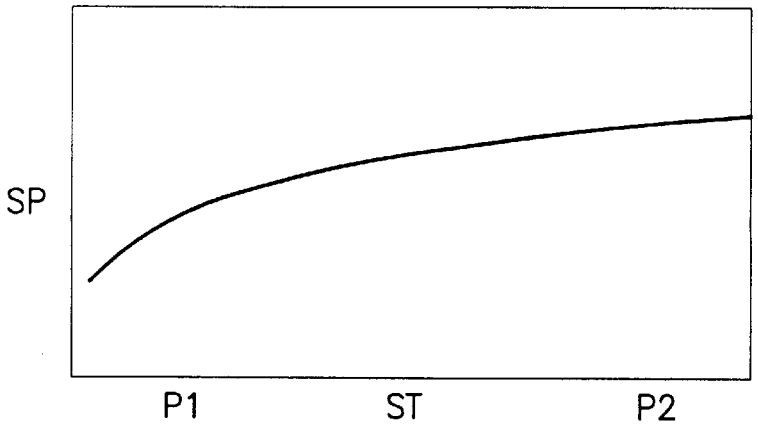
FIG. 5 is a graph of the pitch of the spiral rod of the counterbalance of FIG. 1.

In FIGS. 4 and 5, the pitch of the spiral of the rod changes continuously along the rod at a nonlinear rate so that the lifting force of the balance provided by the combined spiral and spring is constant over the range of travel of the window sash.

Also in FIGS. 4 and 5, the pitch of the spiral of the rod changes continuously along the rod according to a consistent nonlinear rate at which the lifting force of the balance provided by the combined spiral and spring is constant over the range of travel of the sash.

Figure 6:
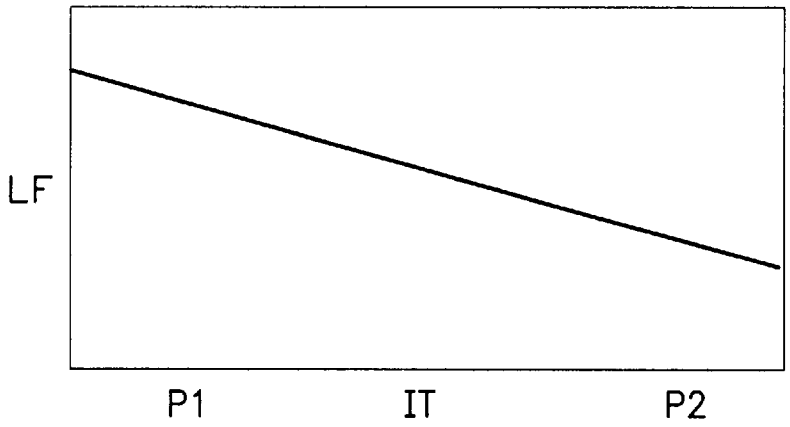
FIG. 6 is a graph of lifting force of another window sash counterbalance of the invention.
Figure 7:
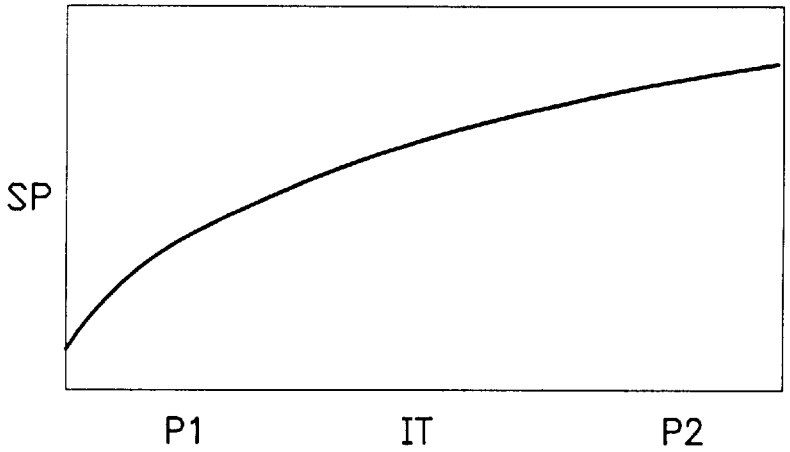
FIG. 7 is a graph of spiral rod pitch for the lifting force of FIG. 6.

In FIGS. 6 and 7, and in FIGS. 4 and 5, the pitch of the spiral of the rod changes continuously along the rod at a consistent nonlinear rate over the length of rod which passes through the follower related to the range of travel of an item counterbalanced by the counter balance mechanism.

Figure 8:
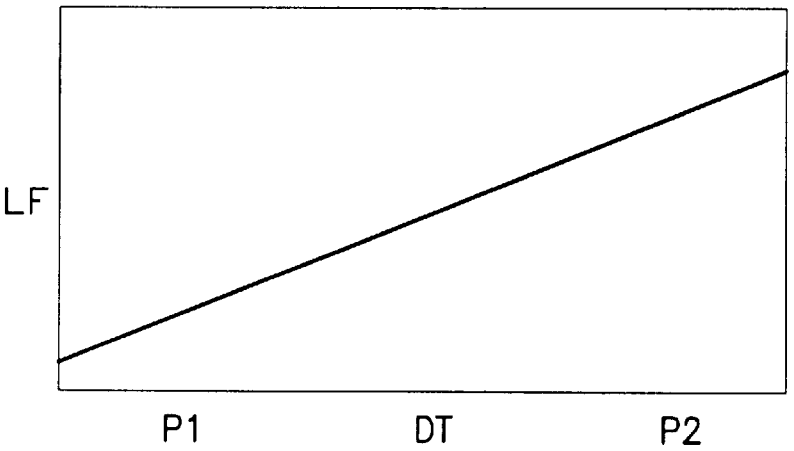
FIG. 8 is a graph of lifting force of another counterbalance of the invention.
Figure 9:
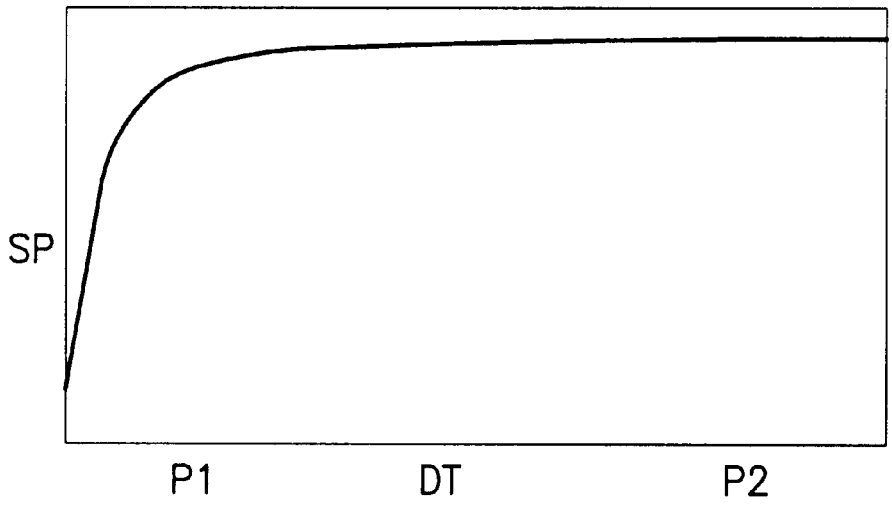
FIG. 9 is a graph of spiral rod pitch for the lifting force of FIG. 8.
Figure 10:
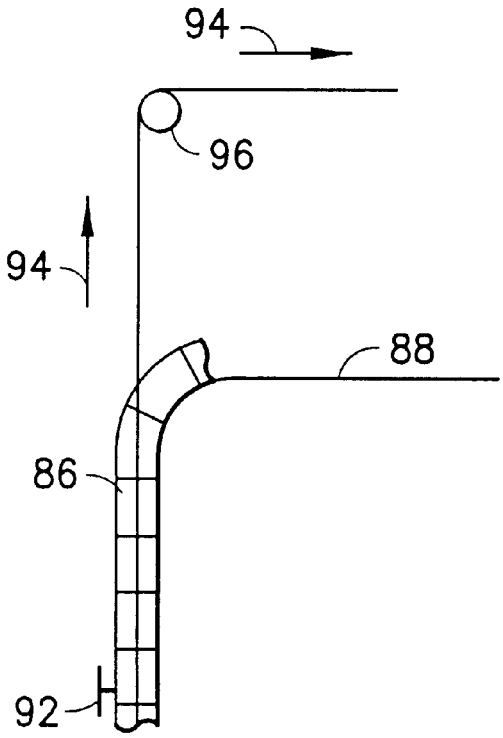
FIG. 10 is a schematic view of a garage door and track being counterbalanced by the invention.

In the garage door 86 and track 88 configuration shown in FIGS. 8, 9 and 10, for the user to experience only minor weight change at handle 92 over the vertical lifting range of the door handle, the lift 94 provided by the counterbalance drawing over a single pulley 96 must change over the range of vertical movement of the door handle.

In FIGS. 6 and 7 and 8 and 9, the pitch of the spiral of the rod changes continuously along the rod at a consistent nonlinear rate so that the lifting force of the balance provided by the combined spiral and spring changes over the range of counterbalanced travel of the counterbalanced item.

Although the present invention has been described with respect to details of certain embodiments thereof, it is not intended that such details be limitations upon the scope of the invention. It will be obvious to those skilled in the art that various modifications and substitutions may be made without departing from the spirit and scope of the invention.

| Drawing designators, informal |
|---|
| 20 counterbalance |
| 22 window frame |
| 24 spring |
| 26 wood screw |
| 28 coil of spring |
| 30 wire |
| 34 mounting collar |
| 36 hole |
| 38 end of spring 24 |
| 40 pin |
| 44 spiral rod |
| 48 sash |
| 50 balance shoe |
| 52 pivot |
| 54 window track |
| 56 length |
| 58 end of spring |
| 60 brake |
| 62 axis |
| 64 constriction |
| 66 opening |
| 68 follower |
| 72 lambda |
| 74 2r |
| 76 rotation angle phi |
| 78 lift |
| 84 plastic tube |
| 86 garage door |
| 88 track |
| 92 handle |
| 94 lift |
| 96 pulley |

What is claimed is:

1. In a counterbalance apparatus comprising a torsion spring having a first end and a second end, means for holding the first end of said torsion spring against rotation connected to the first end of said torsion spring, means for following connected to the second end of said torsion spring, a spiral rod having a first end and a second end, the first end of said spiral rod extending through said means for following and into said torsion spring, the second end of said spiral rod comprising means for attaching an item to be counterbalanced by the counterbalance apparatus, said spiral rod comprising a thread the pitch of which varies along a portion of the rod which extends through said means, for following and into said torsion spring, said means for following being configured to be rotated by the threads of the spiral rod as the spiral rod is reciprocated through the means for following and by said rotation to rotate said second end of said torsion spring, the improvement comprising:

the pitch changing according to the equation:

$$\text{lambda}(z)=\arctan(k(z)*\text{phi}(z)/(L(z)*r(z)))$$

where;

z=distance along the longitudinal axis of the helix;

lambda=helix angle as a function of vertical displacement z, defined as the angle between the helical surface of a thread and a plane perpendicular to the helical rod's longitudinal axis;

k=torsional spring stiffness as a function of vertical displacement z;

phi=rotation of the torsional spring as a function of vertical displacement z;

L=desired lift as a function of vertical displacement z;

r=radius of the spiral rod as a function of vertical displacement z.

2. The counterbalance apparatus of claim 1 in which the second end of said torsion spring is free to rotate on said spiral rod.

3. The counterbalance apparatus of claim 1 in which said torsion spring comprises wire having parallel sides along a substantial length of the wire.

4. In a counterbalance apparatus comprising a torsion spring having a first end and a second end, means for holding the first end of said torsion spring against rotation connected to the first end of said torsion spring, means for following connected to the second end of said torsion spring, a spiral rod having a first end and a second end, the first end of said spiral rod extending through said means for following and into said torsion spring, the second end of said spiral rod comprising means for attaching an item to be counterbalanced by the counterbalance apparatus, said spiral rod comprising a thread the pitch of which varies along a portion of the rod which extends through said means for following and into said torsion spring, said means for following being configured to be rotated by the threads of the spiral rod as the spiral rod is reciprocated through the means for following and by said rotation to rotate said second end of said torsion spring, the improvement comprising:

the pitch change can be described by the equation:

$$\text{lambda}(z)=\arctan(k(z)*\text{phi}(z)/(\text{L}(z)*r(z)))$$

where;

z=distance along the longitudinal axis of the helix;

lambda=helix angle as a function of vertical displacement z, defined as the angle between the helical surface of a thread and a plane perpendicular to the helical rod's longitudinal axis;

k=torsional spring stiffness as a function of vertical displacement z;

phi=rotation of the torsional spring as a function of vertical displacement z;

L=desired lift as a function of vertical displacement z;

r=radius of the spiral rod as a function of vertical displacement z.

5. The counterbalance apparatus of claim 4 in which the second end of said torsion spring is free to rotate on said spiral rod.

6. The counterbalance apparatus of claim 4 in which said torsion spring is made stiff so that it essentially does not stretch when the counterbalance apparatus is balancing an item.

* * * * *